US011512359B2

(12) United States Patent
Hirashima et al.

(10) Patent No.: US 11,512,359 B2
(45) Date of Patent: Nov. 29, 2022

(54) HOT ROLLED STEEL SHEET AND METHOD FOR PRODUCING SAME

(71) Applicant: NIPPON STEEL CORPORATION, Tokyo (JP)

(72) Inventors: Tetsuya Hirashima, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 181 days.

(21) Appl. No.: 16/648,976

(22) PCT Filed: Nov. 22, 2018

(86) PCT No.: PCT/JP2018/043274

§ 371 (c)(1),
(2) Date: Oct. 7, 2020

(87) PCT Pub. No.: WO2019/103121

PCT Pub. Date: May 31, 2019

(65) Prior Publication Data

US 2021/0025019 A1 Jan. 28, 2021

(30) Foreign Application Priority Data

Nov. 24, 2017 (JP) ..... JP2017-225763

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/08*** | (2006.01) |
| ***C22C 38/14*** | (2006.01) |
| ***C22C 38/16*** | (2006.01) |

(52) U.S. Cl.

CPC ..... *C21D 8/0226* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2015/0071812 | A1 | 3/2015 | Kawano et al. |
| 2016/0017465 | A1 | 1/2016 | Toda et al. |
| 2018/0023155 | A1 | 1/2018 | Takeda et al. |
| 2018/0327878 | A1 | 11/2018 | Toyoda et al. |

FOREIGN PATENT DOCUMENTS

| | | | | |
|---|---|---|---|---|
| JP | 61-159528 | A | | 7/1986 |
| JP | 6-29480 | B2 | | 4/1994 |
| JP | 2000-290748 | A | | 10/2000 |
| JP | 2000297349 | A | * | 10/2000 |
| JP | 3725367 | B2 | | 12/2005 |
| JP | 4006112 | B2 | | 11/2007 |
| JP | 2008-138231 | A | | 6/2008 |
| JP | 2014-173151 | A | | 9/2014 |
| WO | WO 2014/171427 | A1 | | 10/2014 |
| WO | WO 2014/014120 | A1 | | 7/2016 |
| WO | WO 2016/136810 | A1 | | 9/2016 |
| WO | WO 2017/085841 | A1 | | 5/2017 |

OTHER PUBLICATIONS

International Search Report for International Application No. PCT/JP2018/043274, dated Jan. 15, 2019, with English translation.

Written Opinion of the International Searching Authority for International Application No. PCT/JP2018/043274, dated Jan. 15, 2019, with English translation.

* cited by examiner

*Primary Examiner* — Anthony M Liang

(74) *Attorney, Agent, or Firm* — Birch, Stewart, Kolasch & Birch, LLP

(57) ABSTRACT

Provided is a hot rolled steel sheet comprising a predetermined composition wherein the hot rolled steel sheet comprises ferrite with an average orientation difference in the same grain of 0.5 to 5.0° in 30 to 70 vol %, the ferrite and martensite in a total of 90 vol % or more, and a balance microstructure of 10 vol % or less, has an average grain size of the ferrite of 0.5 to 5.0 μm, and has an average grain size of the martensite and the balance microstructure of 1.0 to 10 μm. Provided is a method for producing a hot rolled steel sheet comprising rolling where two or more consecutive passes of rolling including a final pass are performed under conditions of a rolling temperature: A point or more and less than $Ae_3$ point, a strain rate: 1.0 to 50/sec, and a time between passes: within 10 seconds and where a total strain amount of all passes satisfying the conditions is 1.4 to 4.0, cooling by a 20° C./sec or more average cooling rate, and coiling the steel sheet at room temperature or more and less than 300° C.

4 Claims, 2 Drawing Sheets

FIG. 1

Table 2-1

| No. | Steel type | Hot rolling | | | | | | | | | | | | | | | | | |
|---|---|---|---|---|---|---|---|---|---|---|---|---|---|---|---|---|---|---|---|
| | | Heating temp. | Total strain amount | F1 | | | | F2 | | | | F3 | | | | F4 | | | |
| | | | | Rolling temp. | Strain amount | Strain rate | Time between passes | Rolling temp. | Strain amount | Strain rate | Time between passes | Rolling temp. | Strain amount | Strain rate | Time between passes | Rolling temp. | Strain amount | Strain rate | Time between passes |
| | | °C | | °C | | /s | s | °C | | /s | s | °C | | /s | s | °C | | /s | s |
| 1 | A | Direct | 1.87 | 1015 | 0.1 | 0.2 | 3.3 | 952 | 0.18 | 1 | 3 | 927 | 0.13 | 2 | 2.6 | 893 | 0.42 | 4 | 1.9 |
| 2 | A | Direct | 1.87 | 976 | 0.39 | 3 | 5.9 | 939 | 0.45 | 6 | 5.4 | 898 | 0.17 | 10 | 4.3 | 867 | 0.7 | 16 | 3.1 |
| 3 | A | Direct | 2.51 | 930 | 0.39 | 0.6 | 5.9 | 870 | 0.17 | 1 | 5.2 | 855 | 0.44 | 2 | 4.8 | 841 | 0.45 | 4 | 4.4 |
| 4 | A | 1200 | - | 1049 | 0.46 | 3 | 6.8 | 1014 | 0.3 | 5 | 6.7 | 978 | 0.17 | 11 | 6.4 | 951 | 0.27 | 20 | 5.5 |
| 5 | A | 1250 | 1.6 | 997 | 0.49 | 1 | 4.4 | 955 | 0.21 | 2 | 4 | 923 | 0.22 | 5 | 3.3 | 886 | 0.27 | 9 | 2.9 |
| 6 | B | Direct | 2.07 | 1035 | 0.28 | 1 | 4.4 | 988 | 0.1 | 2 | 3.8 | 938 | 0.22 | 4 | 2.7 | 866 | 0.21 | 10 | 1.8 |
| 7 | B | Direct | 1.8 | 974 | 0.15 | 0.6 | 6.5 | 944 | 0.28 | 1 | 6.3 | 877 | 0.13 | 4 | 5.7 | 830 | 0.35 | 6 | 4.2 |
| 8 | B | Direct | 2.2 | 963 | 0.32 | 1 | 6.2 | 913 | 0.31 | 2 | 5.7 | 874 | 0.46 | 5 | 4.3 | 847 | 0.62 | 8 | 3.1 |
| 9 | B | 1150 | 2 | 903 | 0.32 | 3 | 4.5 | 854 | 0.43 | 7 | 4 | 829 | 0.22 | 10 | 3.6 | 811 | 0.56 | 15 | 3.3 |
| 10 | B | 1200 | 2.24 | 1038 | 0.28 | 4 | 4.8 | 876 | 0.39 | 10 | 3.8 | 831 | 0.45 | 14 | 2.3 | 819 | 0.65 | 20 | 2 |
| 11 | C | Direct | 1.43 | 1016 | 0.4 | 1 | 4.8 | 986 | 0.25 | 2 | 3.8 | 945 | 0.15 | 4 | 3.5 | 904 | 0.17 | 7 | 3.4 |
| 12 | C | Direct | 2.49 | 943 | 0.2 | 4 | 4.9 | 900 | 0.23 | 10 | 4.6 | 869 | 0.46 | 15 | 3.6 | 845 | 0.54 | 18 | 2.7 |
| 13 | C | Direct | 1.52 | 964 | 0.24 | 3 | 4.9 | 912 | 0.47 | 6 | 4.3 | 888 | 0.19 | 13 | 4 | 850 | 0.29 | 21 | 3.1 |
| 14 | C | 1250 | 1.48 | 991 | 0.16 | 0.4 | 6.7 | 954 | 0.26 | 1 | 5.9 | 913 | 0.21 | 2 | 5.6 | 887 | 0.43 | 4 | 4.5 |
| 15 | C | 1300 | 3.07 | 964 | 0.19 | 0.4 | 4.8 | 928 | 0.34 | 0.8 | 4.2 | 849 | 0.49 | 7 | 2 | 822 | 0.57 | 10 | 1.9 |
| 16 | D | Direct | - | 904 | 0.41 | 1 | 5 | 841 | 0.36 | 2 | 4.8 | 806 | 0.47 | 5 | 4 | 772 | 0.54 | 7 | 3 |
| 17 | D | Direct | 1.49 | 972 | 0.16 | 0.9 | 6.2 | 929 | 0.35 | 2 | 6 | 899 | 0.36 | 4 | 5.1 | 869 | 0.22 | 6 | 4 |
| 18 | D | Direct | 1.98 | 954 | 0.45 | 6 | 5.6 | 917 | 0.18 | 14 | 4.6 | 873 | 0.14 | 16 | 4.1 | 859 | 0.55 | 22 | 3.8 |
| 19 | E | 1200 | 1.83 | 978 | 0.11 | 0.7 | 5.8 | 933 | 0.49 | 1 | 5.4 | 898 | 0.48 | 4 | 4.2 | 854 | 0.68 | 6 | 3.9 |
| 20 | E | 1200 | 1.44 | 1008 | 0.49 | 6 | 4.9 | 974 | 0.33 | 14 | 4.7 | 930 | 0.21 | 20 | 3.7 | 885 | 0.69 | 26 | 3 |
| 21 | E | Direct | 1.6 | 974 | 0.49 | 1 | 6.4 | 943 | 0.18 | 3 | 6.3 | 908 | 0.22 | 7 | 5.1 | 854 | 0.48 | 12 | 4.7 |
| 22 | F | Direct | 1.69 | 1007 | 0.45 | 3 | 5 | 976 | 0.23 | 6 | 4.7 | 933 | 0.26 | 10 | 4.5 | 871 | 0.27 | 16 | 3.5 |
| 23 | F | 1250 | 1.55 | 960 | 0.12 | 0.5 | 5.4 | 917 | 0.42 | 1 | 4.7 | 882 | 0.44 | 2 | 4.2 | 850 | 0.42 | 3 | 3.7 |
| 24 | F | 1150 | 1.66 | 968 | 0.42 | 3 | 4.4 | 927 | 0.27 | 5 | 3.9 | 889 | 0.22 | 6 | 2.4 | 855 | 0.55 | 9 | 2 |
| 25 | G | Direct | 1.43 | 998 | 0.32 | 0.5 | 5.6 | 949 | 0.17 | 0.8 | 4.7 | 901 | 0.5 | 1 | 4 | 866 | 0.53 | 4 | 3.8 |
| 26 | G | Direct | 2.15 | 964 | 0.33 | 3 | 8.3 | 909 | 0.46 | 8 | 7.6 | 879 | 0.23 | 11 | 6.5 | 844 | 0.47 | 18 | 5.9 |
| 27 | G | 1300 | 1.89 | 1000 | 0.36 | 10 | 5.1 | 952 | 0.24 | 15 | 4.4 | 903 | 0.5 | 24 | 3.4 | 854 | 0.48 | 28 | 2.5 |
| 28 | G | 1200 | **0.96** | 1022 | 0.4 | 0.9 | 6.1 | 985 | 0.47 | 2 | 5.7 | 942 | 0.37 | 4 | 5.5 | 897 | 0.43 | 7 | 4.8 |
| 29 | H | Direct | 1.43 | 952 | 0.19 | 0.4 | 5.6 | 918 | 0.13 | 2 | 4.7 | 883 | 0.44 | 4 | 4.5 | 847 | 0.61 | 7 | 3.7 |
| 30 | I | 1250 | 1.43 | 937 | 0.37 | 6 | 4.2 | 887 | 0.34 | 10 | 3.9 | 849 | 0.46 | 16 | 3.7 | 803 | 0.15 | 23 | 3.1 |

Bold underlines show outside scope of present invention.

Cells within bold borders in table show ranges where two or more consecutive passes of rolling including a final pass of finishing rolling respectively satisfy the conditions of rolling temperature:

A point or more and less than Ae3 point, strain rate: 1.0 to 50/sec, and time between passes: within 10 seconds.

FIG. 2

Table 2-2

| No. | Steel type | Hot rolling | | | | | | | | | | | Cooling | | Coiling |
|---|---|---|---|---|---|---|---|---|---|---|---|---|---|---|---|
| | | F5 | | | | F6 | | | | F7 | | | | | |
| | | Rolling temp. °C | Strain amount | Strain rate /s | Time between passes s | Rolling temp. °C | Strain amount | Strain rate /s | Time between passes s | Rolling temp. °C | Strain amount | Strain rate /s | T s | Cooling rate °C/s | Coiling temp. °C |
| 1 | A | 861 | 0.57 | 8 | 1.7 | 844 | 0.64 | 10 | 1.2 | 829 | 0.66 | 17 | 1 | 83 | 144 |
| 2 | A | 849 | 0.2 | 23 | 2.2 | 821 | 0.53 | 31 | 1.5 | 805 | 0.44 | 35 | 2 | 72 | 34 |
| 3 | A | 822 | 0.7 | 7 | 3.1 | 804 | 0.51 | 15 | 2.2 | 798 | 0.24 | 23 | 2 | 93 | 142 |
| 4 | A | 933 | 0.3 | 25 | 4.1 | **920** | 0.34 | 29 | 3 | **907** | 0.61 | 33 | 2 | 97 | 100 |
| 5 | A | 854 | 0.45 | 11 | 1.8 | 833 | 0.49 | 19 | 1.7 | 814 | 0.66 | 29 | 2 | **17** | 149 |
| 6 | B | 831 | 0.69 | 11 | 1.1 | 811 | 0.67 | 16 | 0.7 | 803 | 0.71 | 22 | 8 | 78 | 144 |
| 7 | B | 814 | 0.56 | 9 | 3.5 | 799 | 0.25 | 15 | 2.7 | 784 | 0.64 | 20 | 3 | 95 | 35 |
| 8 | B | 814 | 0.62 | 11 | 2.4 | 803 | 0.42 | 16 | 1.6 | 798 | 0.54 | 26 | 3 | 57 | 38 |
| 9 | B | 799 | 0.46 | 17 | 2.6 | 786 | 0.13 | 22 | 1.3 | 774 | 0.63 | 32 | 2 | 99 | 83 |
| 10 | B | 807 | 0.28 | 22 | 1.6 | 789 | 0.5 | 27 | 0.6 | 770 | 0.36 | 33 | 1 | 47 | **338** |
| 11 | C | 873 | 0.69 | 10 | 3.3 | 831 | 0.72 | 17 | 2.7 | 829 | 0.71 | 24 | 9 | 84 | 117 |
| 12 | C | 833 | 0.63 | 20 | 1.7 | 817 | 0.64 | 24 | 0.6 | 808 | 0.68 | 25 | 1 | 85 | 110 |
| 13 | C | 837 | 0.42 | 25 | 1.1 | 801 | 0.4 | 31 | 0.8 | 830 | 0.41 | 43 | **12** | 88 | 110 |
| 14 | C | 833 | 0.45 | 6 | 3.1 | 801 | 0.5 | 11 | 2.8 | 783 | 0.53 | 18 | 3 | 33 | 27 |
| 15 | C | 801 | 0.61 | 15 | 1.1 | 787 | 0.67 | 24 | 1.4 | 769 | 0.73 | 46 | 2 | 50 | 130 |
| 16 | D | 731 | 0.39 | 8 | 1.6 | **703** | 0.22 | 11 | 0.2 | **681** | 0.33 | 18 | 2 | 65 | 187 |
| 17 | D | 854 | 0.54 | 8 | 2.6 | 844 | 0.36 | 11 | 1.6 | 823 | 0.59 | 17 | 1 | 48 | 136 |
| 18 | D | 849 | 0.6 | 23 | 2.8 | 834 | 0.6 | 29 | 2.7 | 817 | 0.23 | 37 | 4 | 93 | 66 |
| 19 | E | 813 | 0.53 | 7 | 2.7 | 802 | 0.66 | 14 | 2.3 | 787 | 0.64 | 19 | 3 | 68 | 97 |
| 20 | E | 846 | 0.36 | 30 | 2.4 | 803 | 0.69 | 34 | 1.6 | 779 | 0.75 | 38 | 2 | 58 | 133 |
| 21 | E | 804 | 0.41 | 14 | 3.2 | 798 | 0.49 | 22 | 2.4 | 774 | 0.7 | 24 | 1 | 94 | 46 |
| 22 | F | 844 | 0.49 | 18 | 3.4 | 830 | 0.56 | 26 | 3 | 805 | 0.64 | 28 | 5 | 24 | 74 |
| 23 | F | 843 | 0.13 | 6 | 2.9 | 811 | 0.47 | 14 | 2.5 | 788 | 0.53 | 21 | 4 | 22 | 78 |
| 24 | F | 841 | 0.56 | 11 | 1.5 | 817 | 0.21 | 19 | 0.4 | 799 | 0.34 | 29 | 3 | 66 | 173 |
| 25 | G | 837 | 0.66 | 5 | 3.3 | 819 | 0.35 | 8 | 2.1 | 800 | 0.42 | 15 | 7 | 70 | 50 |
| 26 | G | 833 | 0.5 | 20 | 4.4 | 814 | 0.52 | 27 | 2.9 | 798 | 0.66 | 30 | 3 | 50 | 167 |
| 27 | G | 829 | 0.53 | 33 | 1.3 | 800 | 0.64 | 36 | 0.1 | 785 | 0.72 | 38 | 5 | 48 | 124 |
| 28 | G | 860 | 0.1 | 8 | 3.7 | 819 | 0.32 | 15 | 2.2 | 803 | 0.64 | 25 | 1 | 53 | 153 |
| 29 | H | 810 | 0.61 | 9 | 3.2 | 782 | 0.43 | 13 | 2.9 | 764 | 0.39 | 19 | 4 | 59 | 85 |
| 30 | I | 784 | 0.15 | 28 | 2.9 | 779 | 0.6 | 32 | 2.5 | 764 | 0.53 | 35 | 2 | 73 | 106 |

Bold underlines show outside scope of present invention.

Cells within bold borders in table show ranges where two or more consecutive passes of rolling including a final pass of finishing rolling respectively satisfy the conditions of rolling temperature: A point or more and less than Ae3 point, strain rate: 1.0 to 50/sec, and time between passes: within 10 seconds.

HOT ROLLED STEEL SHEET AND METHOD FOR PRODUCING SAME

FIELD

The present invention relates to a tensile strength 590 MPa or more hot rolled steel sheet excellent in fatigue characteristics and stretch flangeability suitable as a material for the structural parts or frames or wheel discs of automobiles and to a method for producing the same.

BACKGROUND

As means for improving the mechanical properties of steel material for automobile use, it is known to be effective to refine the grains in the microstructure of that steel material. Refinement of the grains has been taken up in numerous research and development efforts.

For example, PTL 1 proposes heating a steel ingot or slab containing C: 0.01 to 0.20 wt %, Si: 1.00 wt % or less, Mn: 2.00 wt % or less, Al: 0.10 wt % or less, N: 0.0070 wt % or less, and Nb: 0.005 to 0.15 wt % to Tc=850+139000×[Nb wt %]×[C wt %+12/14N wt %] or less in the case where Nb≤0.015 wt %, heating it to Tc=961+51000×[Nb mass %]×[C mass %+12/14N mass %] or less in the case where Nb>0.015 wt %, hot rolling it in a 850 to $Ar_3$−50° C. temperature range, then cooling it by a cooling rate of 30° C./sec or more, then coiling it in a 450° C. to 150° C. temperature range to thereby produce hot-rolled high tensile steel sheet excellent in strength, ductility, toughness, and fatigue characteristics comprised of a mixed grain microstructure of fine ferrite with a grain size of 2 to 3 μm in an area rate of 70% or more, structures including bainite and martensite in an area rate of 20% or less, and a balance of ferrite with an area rate of an average grain size of 10 μm or less.

Further, PTL 2 proposes heating a continuously cast slab comprised of, by wt %, C: 0.01 to 0.10%, Si: 1.5% or less, Mn: more than 1.0 to 2.5%, P: 0.15% or less, S: 0.008% or less, Al: 0.01 to 0.08%, one or both of Ti and Nb in a total of 0.32 to 0.60%, and a balance of Fe and unavoidable impurities to more than 1100° C. in temperature, then hot rolling it at a finishing rolling temperature of the $Ar_3$ point or more, cooling it by a 10 to 150° C./s cooling rate, and coiling it at a coiling temperature of 500 to 700° C. to produce ultrafine ferrite structure high strength hot rolled steel sheet with an amount of ferrite of, by area rate, 95% or more and an average grain size of ferrite of 2.0 to 10.0 μm, not containing martensite and residual austenite in the microstructure, and having a tensile strength of 490 MPa or more or excellent stretch flangeability.

Further, PTL 3 proposes a method for producing fine grain high tensile steel comprising rolling a steel slab containing, by mass %, C: 0.03 to 0.9%, Si: 0.01 to 1.0%, Mn: 0.01 to 5.0%, Al: 0.001 to 0.5%, N: 0.001 to 0.1%, Nb: 0.003 to 0.5%, and Ti: 0.003 to 0.5%, having a balance of Fe and unavoidable impurities, and satisfying C %+(12/14)N %≥(12/48)Ti %+(12/48)Nb %+0.03% as cast or cooling it once to 500° C. to room temperature without rolling, then heating it to the $Ac_3$ point −100° C. to less than the $Ac_3$ point in temperature and rolling it or cooling it 500° C. to room temperature in temperature by a cooling rate of 0.1 to 50° C./sec without rolling, again heating it to 700° C. or less and 550° C. or more in temperature, and hot rolling it at 700° C. or less and 550° C. or more in temperature during which making the rolling reduction per pass 20% or more and making one pass or the time between passes within 10 seconds in two or more consecutive working operations under conditions giving a strain rate of 1 to 200/sec and a total strain amount of 0.8 or more and 5 or less, then allowing it to cool. In the examples of PTL 3, it is specifically shown that by this method, the grain size of the ferrite is refined to as small as 0.6 μm.

CITATIONS LIST

Patent Literature

[PTL 1] Japanese Examined Patent Publication No. 6-29480
[PTL 2] Japanese Patent No. 3725367
[PTL 3] Japanese Patent No. 4006112

SUMMARY

Technical Problem

Increasing the strength of a material generally causes the fatigue characteristics and stretch flangeability and other material properties to deteriorate, so increasing the strength without causing these material properties to deteriorate becomes important in developing high strength hot rolled steel sheet.

However, in the hot-rolled high tensile steel sheet described in PTL 1, the microstructure is a composite microstructure of ferrite and martensite and bainite. There was the problem that the stretch flangeability was low due to the difference in hardness between the structures.

Further, in the ultrafine ferrite structure high strength hot rolled steel sheet described in PTL 2, ferrite is the main phase, so the strength is low. Further, the contents of Nb and Ti are great, so there was the problem that the economic efficiency was low.

Further, in the method for producing high tensile steel described in PTL 3, interposition of a cooling process before rolling is liable to promote precipitation of carbides etc. Even in the subsequent reheating process, the temperature is a relatively low one of the $Ac_3$ point −100° C. to less than the $Ac_3$ point. If such precipitates are formed, they are hard to dissolve. In the finally obtained microstructure, the coarse precipitates remain. As a result, sometimes it was not necessarily possible to achieve sufficiently high stretch flangeability.

The present invention has as its object to solve the above-mentioned problems in the prior art and provide a tensile strength 590 MPa or more hot rolled steel sheet excellent in fatigue characteristics and stretch flangeability and a method for producing the same.

BRIEF DESCRIPTION OF THE DRAWINGS

FIG. 1 shows Table 2-1, which includes data related to Examples and Comparative Examples discussed herein.

FIG. 2 shows Table 2-2, which includes data related to Examples and Comparative Examples discussed herein.

SOLUTION TO PROBLEM

To achieve the above-mentioned object, the inventors researched in depth techniques for reducing the difference in hardness between ferrite and the balance microstructure in hot rolled steel sheet and furthermore techniques for refining grains not having Nb and Ti as essential constituents in consideration of economy. As a result, they discovered that even in dual phase structure steel with a large difference in hardness between structures such as with ferrite and martensite, if the average orientation difference of the ferrite in the same grain is large, the stretch flangeability is improved. Further, they discovered that even if not containing Nb and Ti, by optimizing the rolling temperature, strain rate, time between passes, and total strain amount in the production process of hot rolled steel sheet, it is possible to cause ferrite transformation during rolling and refine the ferrite to an average grain size of 5.0 μm or less. Further, they discovered that high density dislocations are introduced into the ferrite produced in this way, so dislocation strengthening occurs and that the average orientation difference of ferrite in the same grains is also large, so it becomes possible to obtain hot rolled steel sheet having high strength and excellent in fatigue characteristics and stretch flangeability.

The present invention was completed by further study based on these discoveries. That is, the gist of the present invention is as follows:

[1] A hot rolled steel sheet comprising a composition comprising, by mass %,

C: 0.01% or more and 0.20% or less,

Si: 1.0% or less,

Mn: 3.0% or less,

P: 0.040% or less,

S: 0.004% or less,

Al: 0.10% or less,

N: 0.004% or less, and a balance of Fe and impurities, wherein the hot rolled steel sheet comprises ferrite with an average orientation difference in the same grain of 0.5° or more and 5.0° or less in 30 vol % or more and 70 vol % or less, the ferrite and martensite in a total of 90 vol % or more, and a balance microstructure of 10 vol % or less, and the hot rolled steel sheet has an average grain size of the ferrite of 0.5 μm or more and 5.0 μm or less, has an average grain size of the martensite of 1.0 μm or more and 10 μm or less, and, when there is the balance microstructure, has an average grain size of the balance microstructure of 1.0 μm or more and 10 μm or less.

[2] The hot rolled steel sheet according to [1], further comprising, by mass %, one or more selected from Nb: 0.01% or more and 0.20% or less, Ti: 0.01% or more and 0.15% or less, Mo: 0.01% or more and 1.0% or less, Cu: 0.01% or more and 0.5% or less, and Ni: 0.01% or more and 0.5% or less.

[3] A method for producing a hot rolled steel sheet comprising:

(a) hot rolling a steel stock comprising the composition according to [1] or [2] without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less, (b) cooling the finishing rolled steel sheet by a 20° C./sec or more average cooling rate, wherein the cooling is started within 10 seconds after the hot rolling, and (c) coiling the steel sheet at room temperature or more and less than 300° C. in temperature range, where, the A point is a temperature found by the following (formula 1) and the $Ae_3$ point is a temperature found by the following (formula 2):

$$A(^\circ C.)=910-310C-80Mn-20Cu-55Ni-80Mo \quad \text{(formula 1)}$$

$$Ae_3(^\circ C.)=919-266C+38Si-28Mn-27Ni+12Mo \quad \text{(formula 2)}$$

where, C, Si, Mn, Cu, Ni, and Mo are the contents (mass %) of the elements.

Advantageous Effects of Invention

According to the present invention, it is possible to obtain hot rolled steel sheet high in strength and having extremely excellent stretch flangeability and fatigue characteristics. If applying the present invention to the structural parts of automobiles etc., it is possible to secure the safety of the automobiles while making car bodies lighter in weight and reducing the environmental load.

DESCRIPTION OF EMBODIMENTS

<Hot Rolled Steel Sheet>

The hot rolled steel sheet of the present invention has a predetermined composition, contains ferrite with an average orientation difference in the same grain of 0.5° or more and 5.0° or less in 30 vol % or more and 70 vol % or less, contains the ferrite and martensite in a total of 90 vol % or more, has a balance microstructure of 10 vol % or less, has an average grain size of the ferrite of 0.5 μm or more and 5.0 μm or less, has an average grain size of the martensite of 1.0 μm or more and 10 μm or less, and, when having the balance microstructure, has an average grain size of the balance microstructure of 1.0 μm or more and 10 μm or less.

Below, the hot rolled steel sheet of the present invention will be explained specifically. First, the reasons for limiting the chemical constituents (composition) of the hot rolled steel sheet of the present invention will be explained. Note that the "%" expressing the chemical constituents below all mean "mass %".

[C: 0.01% or More and 0.20% or Less]

C is an element which improves the solution strengthening and hardenability and which is essential for forming the low temperature transformed phases of martensite at the balance microstructure to secure the strength of the hot rolled steel sheet. For this reason, at the least, 0.01% or more is necessary. The content of C may also be 0.02% or more, 0.04% or more, or 0.05% or more. On the other hand, more than 0.20% of C causes the workability and weldability to deteriorate. Therefore, the content of C is 0.20% or less. The content of C may also be 0.18% or less, 0.16% or less, or 0.15% or less.

[Si: 1.0% or Less]

Si is an element which keeps coarse oxides or cementite causing deterioration of the toughness from forming and also contributes to solution strengthening, but if the content is more than 1.0%, the hot rolled steel sheet remarkably deteriorates in surface properties and a drop in chemical convertability and corrosion resistance is invited. Therefore, the content of Si is 1.0% or less. Preferably, it is 0.9% or less or 0.8% or less. The content of Si may also be 0%. For example, it may be 0.01% or more, 0.02% or more, or 0.4% or more.

[Mn: 3.0% or Less]

Mn is an element which forms a solid solution to contribute to increasing the strength of the steel and improves the hardenability. On the other hand, if Mn is more than 3.0%, not only does the effect become saturated, but also segregated solidification causes formation of band-shaped structures and causes deterioration of the workability and delayed fracture resistance. Therefore, the content of Mn is 3.0% or less. Preferably, it is 2.8% or less or 2.0% or less. The content of Mn may also be 0%. For example, it may be 0.5% or more, 1.0% or more, or 1.4% or more.

[P: 0.040% or Less]

P is an element forming a solid solution to contribute to increase of strength of the steel, but is an element which segregates at the grain boundaries, in particular the prior austenite grain boundaries, and invites a decline in the low temperature toughness and workability. Therefore, the content of P is preferably reduced as much as possible, but a content of up to 0.040% is allowable. Therefore, the content of P is 0.040% or less. Preferably, it is 0.030% or less, more preferably 0.020% or less. The content of P may also be 0%, but even if greatly reducing it, an effect commensurate with the increase in the refining costs cannot be obtained, so preferably the content is 0.001%, 0.002% or more, 0.003% or more, or 0.005% or more.

[S: 0.004% or Less]

S bonds with Mn to form coarse sulfides and causes a drop in the workability of the hot rolled steel sheet. For this reason, the content of S is preferably reduced as much as possible, but containing it up to 0.004% is allowable. Therefore, the content of S is 0.004% or less. Preferably, it is 0.003% or less, more preferably 0.002% or less. The content of S may also be 0%, but even if greatly reducing it, an effect commensurate with the increase in the refining costs cannot be obtained, so preferably the content is 0.0003% or more, 0.0005% or more, or 0.001% or more.

[Al: 0.10% or Less]

Al is an element which acts as a deoxidizer and is effective for improving the cleanliness of the steel. However, excessive addition of Al invites an increase in oxide-based inclusions, causes a drop in toughness of the hot rolled steel sheet, and causes formation of flaws. Therefore, the content of Al is 0.10% or less. Preferably it is 0.09% or less, more preferably 0.08% or less. The content of Al may also be 0%, but even if greatly reducing it, an effect commensurate with the increase in the refining costs cannot be obtained, so preferably the content is 0.005% or more, 0.008% or more, or 0.01% or more.

[N: 0.004% or Less]

N bonds with nitride-forming elements to thereby precipitate as nitrides and contribute to refinement of the grains. However, if more than 0.004%, it becomes present as solid solution N and causes a drop in the toughness. Therefore, the content of N is 0.004% or less. Preferably, it is 0.003% or less. The content of N may also be 0%, but even if greatly reducing it, an effect commensurate with the increase in the refining costs cannot be obtained, so preferably the content is 0.0005% or more, 0.0008% or more, or 0.001% or more.

The above were the basic constituents of the hot rolled steel sheet of the present invention, but the hot rolled steel sheet of the present invention may, if necessary for the purpose of for example improving the toughness, increasing the strength, etc., further contain one or more selected from Nb: 0.01% or more and 0.20% or less, Ti: 0.01% or more and 0.15% or less, Mo: 0.01% or more and 1.0% or less, Cu: 0.01% or more and 0.5% or less, and Ni: 0.01% or more and 0.5% or less.

[Nb: 0.01% or More and 0.20% or Less]

Nb is an element which contributes to increase of the strength and fatigue strength of the steel sheet through formation of carbonitrides. To cause such an effect to be manifested, the content of Nb has to be 0.01% or more. For example, the content of Nb may be 0.02% or more or 0.03% or more. On the other hand, if the content of Nb is more than 0.20%, the deformation resistance increases, so the rolling load in the hot rolling at the time of production of hot rolled steel sheet increases, the load on the rolling machines becomes too great, and the rolling operation itself is liable to become difficult. Further, if the content of Nb is more than 0.20%, coarse precipitates are formed and the hot rolled steel sheet tends to fall in toughness. Therefore, the content of Nb is 0.20% or less. For example, the content of Nb is 0.15% or less or 0.10% or less.

[Ti: 0.01% or More and 0.15% or Less]

Ti forms fine carbonitrides to refine the grains and thereby improve the strength and fatigue strength of the steel sheet. To cause such an effect to be manifested, the content of Ti has to be 0.01% or more. For example, the content of Ti may be 0.02% or more, 0.04% or more, or more than 0.05%. On the other hand, if the content of Ti becomes excessive at more than 0.15%, the above-mentioned effect becomes saturated and further an increase in coarse precipitates is invited and a drop in toughness of the steel sheet is invited. Therefore, the content of Ti is 0.15% or less. Preferably it is 0.14% or less or 0.10% or less.

[Mo: 0.01% or More and 1.0% or Less]

Mo is an element improving the hardenability and contributing to higher strength of the steel sheet. To obtain such an effect, the content of Mo has to be 0.01% or more. For example, the content of Mo may be 0.02% or more or 0.03% or more. However, Mo is high in alloy cost and, if more than 1.0%, causes the weldability to deteriorate. Therefore, the content of Mo is 1.0% or less. Preferably it is 0.5% or less or 0.4% or less.

[Cu: 0.01% or More and 0.5% or Less]

Cu is an element which forms a solid solution and contributes to increase of strength of the steel. Further, Cu improves the hardenability. To obtain these effects, the content of Cu has to be 0.01% or more. For example, the content of Cu may be 0.05% or more or 0.1% or more. However, if the content of Cu is more than 0.5%, a drop in the surface properties of the hot rolled steel sheet is invited. Therefore, the content of Cu is 0.5% or less. Preferably, it is 0.4% or less or 0.3% or less.

[Ni: 0.01% or More and 0.5% or Less]

Ni is an element which forms a solid solution to contribute to increase of strength of the steel and, further, improves the hardenability. To obtain these effects, the content of Ni has to be 0.01% or more. For example, the content of Ni may be 0.02% or more or 0.1% or more. However, Ni is high in alloy cost and, if more than 0.5%, causes the weldability to deteriorate. Therefore, the content of Ni is 0.5% or less. Preferably, it is 0.4% or less or 0.3% or less.

Other elements may also be included within a range not interfering with the effect of the present invention. That is, the balance may be substantially iron. For example, for the purpose of improving the delayed fracture resistance, Ca, REMs (rare earth metals), etc. may be included in respective amounts of 0.005% or less. Trace elements etc. improving the hot workability may also be included.

In the hot rolled steel sheet of the present invention, the balance other than the above constituents is comprised of Fe and impurities. Here, "impurities" mean constituents which are mixed in due to various factors in the process of production such as raw materials like metal or scrap when industrially producing hot rolled steel sheet and encompass all constituents not intentionally added to the hot rolled steel sheet of the present invention. Further, "impurities" also encompass elements which are other than the constituents explained above and which are included in the hot rolled steel sheet at a level where the actions and effects distinctive to those elements do not affect the characteristics of the hot rolled steel sheet according to the present invention.

Next, the reasons for limiting the microstructure of the hot rolled steel sheet according to the present invention will be explained.

[Ferrite with an Average Orientation Difference in the Same Grain of 0.5° or More and 5.0° or Less: 30 Vol % or More and 70 Vol % or Less]

The microstructure of the hot rolled steel sheet of the present invention includes ferrite with an average orientation difference in the same grain of 0.5° or more and 5.0° or less of 30 vol % or more and 70 vol % or less.

Here, in the present invention, "the average orientation difference in the same grain" is an indicator expressing the disorder in crystals present in a certain single grain when defining something with an orientation difference from adjacent grains of 15° or more as a single grain. In the ferrite produced by usual ferrite transformation, the average orientation difference in the same grain is almost always 0.0°. On the other hand, if ferrite transformation occurs during rolling like in the present invention, the ferrite is also worked, so disorder in crystals occurs in the ferrite grains and the average orientation difference in the same grain becomes larger. To reduce the difference in hardness from martensite, the average orientation difference in the same grain has to be 0.5° or more. On the other hand, if the average orientation difference in the same grain is more than 5.0°, the ductility of the ferrite deteriorates. Therefore, the average orientation difference in the same grain is 0.5° or more and 5.0° or less. More preferably it is 0.7° or more and 3.5° or less.

In the hot rolled steel sheet according to the present invention, if the ferrite with an average orientation difference in the same grain of 0.5° or more and 5.0° or less is less than 30 vol %, the fraction of the fine structures falls and securing sufficient fatigue characteristics becomes difficult, so the volume rate of the ferrite is 30 vol % or more. Further, to increase the volume ratio of the ferrite, the rolling reduction at the time of hot rolling has to be raised or the temperature at the time of hot rolling has to be lowered, but if made conditional on being more than 70 vol %, the possibility of the average orientation difference in the same grain being more than 5.0° will become higher and the ferrite is liable to deteriorate in ductility and the stretch flangeability is liable to fall. Therefore, the volume rate of ferrite with an average orientation difference in the same grain of 0.5° or more and 5.0° or less is 30 vol % or more and 70 vol % or less. Preferably, it is 35 vol % or more or 40 vol % or more and/or 65 vol % or less or 60 vol % or less.

[Ferrite with an Average Orientation Difference in the Same Grain of 0.5° or More and 5.0° or Less and Martensite in Total 90 Vol % or More and Balance Microstructure in 10 Vol % or Less]

The hot rolled steel sheet according to the present invention contains ferrite with an average orientation difference in the same grain of 0.5° or more and 5.0° or less and martensite in a total of 90 vol % or more, preferably 95 vol % or more or 100 vol %. The balance microstructure is not particularly limited, but for example the sheet contains one or more of bainite, ferrite with an average orientation difference in the same grain of less than 0.5°, and residual austenite or is comprised of one or more of bainite, ferrite with an average orientation difference in the same grain of less than 0.5°, and residual austenite. If the balance microstructure becomes greater than 10 vol %, it becomes difficult to achieve the desired strength and/or stretch flangeability, so the balance microstructure is 10 vol % or less. More preferably the balance microstructure is 5 vol % or less. It may also be 0 vol %. Further, if the balance microstructure is more than 10 vol % and the bainite fraction in the balance microstructure is relatively high, the fatigue characteristics will sometimes fall.

[Average Grain Size of Ferrite with an Average Orientation Difference in the Same Grain of 0.5° or More and 5.0° or Less: 0.5 μm or More and 5.0 μm or Less]

In the present invention, the "average grain size" is the value calculated when defining something with a difference of orientation from the adjacent grains of 15° or more as a single crystal grain. If the average grain size of ferrite with an average orientation difference in the same grain of 0.5° or more and 5.0° or less is more than 5.0 μm, the fatigue strength and toughness deteriorate, so the average grain size has to be 5.0 μm or less. On the other hand, to make the average grain size smaller than 0.5 μm, large strain working becomes necessary at the time of rolling, a large load acts on the rolling machines, and the possibility of the average orientation difference in the same grain becoming more than 5.0° becomes higher. For this reason, the average grain size is made 0.5 μm or more. Therefore, the average grain size of ferrite with an average orientation difference in the same grain of 0.5° or more and 5.0° or less is 0.5 μm or more and 5.0 μm or less, preferably 0.7 μm or more or 1.0 μm or more, and/or 4.5 or less or 4.0 μm or less.

[Average Grain Size of Martensite and Balance Microstructure: 1.0 μm or More and 10 μm or Less]

If the average grain size of the martensite and any existing balance microstructure is smaller than 1.0 μm, the martensite and the bainite contained in the balance microstructure etc. become high in strength, the difference in hardness with the ferrite becomes greater, and the stretch flangeability deteriorates. Further, if becoming greater than 10 μm, deterioration of the fatigue characteristics and toughness would be a concern. Therefore, the average grain size of the martensite and the balance microstructure, in particular the bainite, is 1.0 μm or more and 10 μm or less, preferably 1.5 μm or more or 2.0 μm or more and/or 8.0 μm or less or 5.0 μm or less.

The phases or the structures can be identified and the average grain size can be calculated by image processing using a structural photograph taken by a scan electron microscope or electron back scatter analysis (EBSP or EBSD).

More specifically, the volume rate of ferrite with an average orientation difference in the same grain of 0.5° or more and 5.0° or less is determined as follows. When designating the width of the steel sheet as W, a sample is taken at a position of ¼W (width) or ¾ W (width) from one end in the width direction of the steel sheet so that the cross-section (cross-section in width direction) of the width direction of the steel sheet seen from the rolling direction becomes the observed surface. Rectangular regions of width direction 200 μm×thickness direction 100 μm of the steel sheet at ¼ depth position of sheet thickness from the surface of the steel sheet are analyzed by EBSD at 0.2 μm measurement intervals. Here, the EBSD analysis is, for example, performed using an apparatus comprised of a thermal field emission type scan electron microscope and an EBSD detector at an analysis speed of 200 to 300 points/sec. Here, the orientation difference is the difference in crystal orientations between adjacent measurement points found based on crystal orientation information of measurement points measured by the above. When this orientation difference is 15° or more, the boundary between adjacent measurement points is judged to be a grain boundary and the region surrounded by that grain boundary is defined as a grain in the present invention. A simple average is found of the orientation difference in the same grain of that grain to calculate the average orientation difference. Further, the area rate of the grains of ferrite with an average orientation difference in the same grain of 0.5° or more and 5.0° or less is found. This is made the volume rate of the ferrite with an average orientation difference in the same grain of 0.5° or more and 5.0° or less. Note that, the average orientation difference in the same grain can be found using software attached to the EBSD analysis apparatus. Further, martensite may also have an average orientation difference in the same grain of 0.5° or more, but martensite is shaped exhibiting a lath-like microstructure, so something having a lath-like structure in an SEM image is deemed martensite. The area rate is made the volume rate of the martensite.

The average grain sizes of the "ferrite with an average orientation difference in the same grain of 0.5° or more and 5.0° or less", "martensite", and "balance microstructure" are determined using values found by the above EBSD analysis. Specifically, the value calculated by the following formula when defining a boundary with an orientation difference of 15° or more as a grain boundary is defined as the average grain size. In the formula, N is the number of grains included in a region for evaluation of the average grain size, Ai is the area of the i-th (i=1, . . . , N) grain, and di is the circle equivalent diameter of the i-th grain. These data are easily found by EBSD analysis.

[Mathematical 1]

$$D = \frac{\sum_{i=1}^{N} Ai \times di}{\sum_{i=1}^{N} Ai}$$

According to the present invention, by satisfying the above chemical constituents (composition) and microstructure, it is possible to obtain hot rolled steel sheet high in strength and excellent in fatigue characteristics and stretch flangeability. Therefore, when applying the hot rolled steel sheet according to the present invention to a structural part of an automobile etc., it is possible to make the sheet thickness thinner while securing the necessary strength and possible to contribute to improve fuel efficiency of automobiles.

<Method for Producing Hot Rolled Steel Sheet>

Next, the method for producing the hot rolled steel sheet according to the present invention will be explained.

The method for producing the hot rolled steel sheet according to the present invention comprises (a) hot rolling a steel stock comprising the chemical constituents (composition) explained above without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 seconds, and a total strain amount of all of the passes satisfying the conditions is 1.4 or more and 4.0 or less, (b) cooling the finishing rolled steel sheet by a 20° C./sec or more average cooling rate, wherein the cooling is started within 10 seconds after the hot rolling, and (c) coiling the steel sheet at room temperature or more and less than 300° C. in temperature range, where, the A point is a temperature found by the following (formula 1) and the $Ae_3$ point is a temperature found by the following (formula 2):

$$A(°\ C.)=910-310C-80Mn-20Cu-55Ni-80Mo \quad \text{(formula 1)}$$

$$Ae_3(°\ C.)=919-266C+38Si-28Mn-27Ni+12Mo \quad \text{(formula 2)}$$

where, C, Si, Mn, Cu, Ni, and Mo are the contents (mass %) of the elements.

Below, the method of production of the present invention will be explained in detail.

[(a) Hot Rolling]

The hot rolling includes finishing rolling by continuously running a cast steel stock having the chemical composition (constituents) explained above through a plurality of rolling stands. Further, descaling may be performed before the finishing rolling or in the middle of rolling between rolling stands in the finishing rolling. In the method of the present invention, the finishing rolling, as explained later, is performed by a low strain rate so as to cause ferrite transformation during the rolling. Therefore, the finishing rolling is preferably performed by direct rolling connecting continuous casting and finishing rolling where such rolling at a low strain rate is easily performed. However, the technique of reheating-roughing rolling-finishing rolling a slab of the general hot rolling method may also be adopted. In that case, the slab heating temperature is 1100° C. or more for homogenizing the slab and is 1350° C. or less for preventing coarsening of the austenite grain size. Further, the method for producing the steel stock is not limited to any specific method. Any commonly used method refining molten steel having the above-mentioned chemical constituents in a converter etc. and casting it into a slab or other steel stock by continuous casting or other casting method can be applied.

(Rolling Temperature at all Rolling Stands of Finishing Rolling: A Point or More)

In the method of the present invention, the finishing rolling is performed by continuously running the as-cast steel stock, that is, the steel stock right after casting, or a heated steel stock through a plurality of rolling stands. The rolling temperature in all of the rolling stands of the finishing rolling is the A point found by the following (formula 1) or more.

$$A(°\ C.)=910-310C-80Mn-20Cu-55Ni-80Mo \quad \text{(formula 1)}$$

where, C, Mn, Cu, Ni, and Mo are the contents of the elements (mass %).

If becoming less than the A point, in addition to the ferrite transformation during rolling, ferrite transformation occurs accompanying the lower temperature. The ferrite formed by the latter ferrite transformation is large in grain size and invites a drop in tensile strength and fatigue strength. Further, due to the formation of such ferrite, control of the makeup of the microstructure also becomes difficult. Therefore, the temperature at all of the rolling stands has to be the A point or more. For example, the temperature at all of the rolling stands may be 1100° C. or less.

(Rolling Temperature of Two or More Consecutive Passes of Rolling Including Final Pass of Finishing Rolling: A Point or More and Less than $Ae_3$ Point) If this rolling temperature becomes the $Ae_3$ point found by the following (formula 2) or more, it becomes difficult to cause ferrite transformation during rolling, so the temperature is less than the $Ae_3$ point.

$$Ae_3(^\circ C.)=919-266C+38Si-28Mn-27Ni+12Mo \quad \text{(formula 2)}$$

where, C, Si, Mn, Ni, and Mo are the contents of the elements (mass %).

Further, if becoming less than the A point, in addition to the ferrite transformation during rolling, ferrite transformation occurs accompanying the lower temperature. The ferrite formed by the latter ferrite transformation is large in grain size and invites a drop in tensile strength and fatigue strength. Further, due to the formation of such ferrite, control of the makeup of the microstructure also becomes difficult. Therefore, the rolling temperature of two or more consecutive passes of rolling including the final pass of finishing rolling is the A point or more and less than the $Ae_3$ point.

(Strain Rate of Two or More Consecutive Passes of Rolling Including Final Pass of Finishing Rolling: 1.0 to 50/Sec)

To cause ferrite transformation during rolling, the strain rate is preferably a low rate. If the strain rate is more than 50/sec, the rolling reduction required for causing ferrite transformation becomes greater and the load on the rolling machine increases. Further, the heat generated by the work becomes greater and the possibility of the rolling temperature becoming the $Ae_3$ point or more becomes higher. Therefore, the strain rate is 50/sec or less. Further, if the strain rate is less than 1.0/sec, the effect of the heat removal by the rolls of the rolling machined becomes greater and the possibility of the rolling temperature becoming less than the A point becomes higher. Therefore, the strain rate is 1.0/sec or more and 50/sec or less. More preferably it is 1.5/sec or more and 30/sec or less.

(Time Between Passes of Two or More Consecutive Passes of Rolling Including Final Pass of Finishing Rolling: Within 10 Seconds)

The time between passes affects the recovery of strain between the rolling stands and the recrystallization behavior. If the time between passes is more than 10 seconds, recovery of strain between stands and recrystallization occur and the strain stored in the preceding rolling passes ends up being released, so causing ferrite transformation during rolling becomes difficult. Therefore, the time between passes is within 10 seconds. Preferably it is within 8.5 seconds, within 7 seconds, or within 5 seconds. For example, the time between passes may be 1 second or more.

(Total Strain Amount: 1.4 or More and 4.0 or Less)

The total strain amount of all of the passes where the two or more consecutive passes of rolling including the final pass of the above finishing rolling satisfy the conditions of the rolling temperature: A point or more and less than $Ae_3$ point, strain rate: 1.0 to 50/sec, and time between passes: within 10 seconds is 1.4 or more and 4.0 or less. This total strain amount has a great effect on the amount of ferrite transformation and the average orientation difference in the ferrite grains occurring and refinement of martensite occurring during rolling. If the total strain amount is less than 1.4, a sufficient amount of ferrite transformation is difficult to cause. Further, the martensite crystal grain size becomes coarser. On the other hand, if the total strain amount is more than 4.0, the average orientation difference in the same grain of the ferrite formed during rolling becomes more than 5.0 and the ferrite falls in ductility. In addition to this, the amount of ferrite transformation during rolling becomes greater and the amount of martensite decreases, so insufficient strength is invited. Therefore, the total strain amount is 1.4 or more and 4.0 or less. Preferably it is 1.6 or more and 3.5 or less.

If the above rolling conditions do not continue, ferrite transformation can no longer be caused during rolling and/or the ferrite formed during rolling transforms back to austenite resulting in the ferrite fraction of the final microstructure becoming smaller and the elongation of the obtained hot rolled steel sheet falling. Further, if the final pass does not satisfy the rolling conditions, transformation of ferrite back to austenite occurs in the final pass and the ferrite fraction in the final microstructure decreases causing the elongation to drop and/or the ferrite recovers and the difference in hardness from martensite becomes greater and the stretch flangeability falls. Alternatively, further, if the rolling temperature of the final pass becomes less than the A point, in addition to the ferrite transformation during rolling, ferrite transformation occurs accompanying the lower temperature. The ferrite formed by the latter ferrite transformation is large in grain size and a drop in the tensile strength or fatigue strength is invited. Therefore, the two or more consecutive passes of rolling including the final pass of the above finishing rolling must be performed under the conditions of the rolling temperature: A point or more and less than $Ae_3$ point, strain rate: 1.0 to 50/sec, and time between passes: within 10 seconds and so that the total strain amount of all of the passes satisfying the conditions becomes 1.4 or more and 4.0 or less.

(Roughing Rolling)

In the method of the present invention, for example, for adjusting the sheet thickness etc., the steel stock may be roughing rolled before the finishing rolling. The roughing rolling need only secure the desired sheet bar dimensions. The conditions are not particularly limited.

[(b) Cooling]

According to the method of the present invention, the finishing rolled steel sheet is cooled in the cooling step by a 20° C./sec or more average cooling rate. The cooling is started within 10 seconds after the above hot rolling. If more than 10 seconds from the end of the hot rolling to the start of cooling, the ferrite recovers, the difference in hardness from martensite becomes greater, and the obtained hot rolled steel sheet falls in stretch flangeability. Preferably, the cooling is started within 9 seconds or within 8 seconds after the hot rolling. Further, if the average cooling rate is less than 20° C./sec, the strain in the ferrite recovers causing softening, the difference in hardness from martensite becomes greater, and a drop in the stretch flangeability occurs. Therefore, the average cooling rate after the hot rolling is 20° C./sec or more. Preferably it is 40° C./sec or more. The upper limit of the average cooling rate is not particularly set, but for example may be 100° C./sec or less.

[(c) Coiling]

The steel sheet cooled down to the above cooling stop temperature in the above cooling is coiled up in the coiling step at room temperature or more and less than 300° C. The steel sheet is coiled right after the cooling, so the coiling temperature is substantially equal to the cooling stop temperature. If the coiling temperature becomes 300° C. or more, polygonal ferrite or bainite is formed in a large amount, so the tensile strength and fatigue strength fall. Therefore, the coiling temperature which becomes the cooling stop temperature is less than 300° C. For example, the coiling temperature may be 250° C. or less or 200° C. or less.

Note that, after coiling, the hot rolled steel sheet may be skin-pass rolled in accordance with an ordinary method.

Further, it may be pickled to remove the scale formed on its surface. Alternatively, further, it may be hot dip galvanized, electrogalvanized, or otherwise plated or chemically converted.

By casting steel stock having the same composition as that explained for the hot rolled steel sheet of the present invention, then, as explained above, hot rolling it, then cooling and coiling it, it is possible to reliably produce hot rolled steel sheet containing ferrite with an average orientation difference in the same grain of 0.5° or more and 5.0° or less in 30 vol % or more and 70 vol % or less, containing the ferrite and martensite in a total of 90 vol % or more, having a balance microstructure of 10 vol % or less, having an average grain size of ferrite of 0.5 μm or more and 5.0 μm or less, having an average grain size of martensite of 1.0 μm or more and 10 μm or less, and, when there is the balance microstructure, having an average grain size of the balance microstructure of 1.0 μm or more and 10 μm or less. For this reason, according to the above method of production, it is possible to provide hot rolled steel sheet with a tensile strength of 590 MPa or more excellent in fatigue characteristics and stretch flangeability.

Below, examples will be used to explain the present invention in further detail, but the present invention is not limited to these examples in any way.

EXAMPLES

Molten steels of the chemical compositions shown in Table 1 were refined in a converter. Next, these steel stocks were hot rolled, cooled, and coiled under the conditions shown in Table 2 to manufacture thickness 3.0 mm hot rolled steel sheets. The balances other than the constituents shown in Table 1 consisted of Fe and impurities. Further, samples taken from the manufactured hot rolled steel sheets were analyzed. The chemical compositions were equivalent to the chemical compositions of the steels shown in Table 1.

[Table 1]

In Table 2, the "heating temperature" is the temperature in the case of reheating the slab. "Direct" shows performing finishing rolling by hot direct rolling connecting continuous casting and finishing rolling. Further, "F1" to "F7" show the rolling stands in the finishing rolling, the "rolling temperature" in each field shows the temperature at the entrance side of the stand, and the "time between passes" shows the time from right after exiting a stand to reaching the next stand. Further, "T" shows the time from after the hot rolling (after end of finishing rolling) to the start of cooling. Further, the cooling after finishing rolling was made water cooling and was performed by running the steel sheet through a water cooling facility not having air cooling sections. The cooling rate at the time of cooling is shown by the average rate obtained by dividing the amount of drop of temperature of the steel sheet from when being led into the water cooling facility to when being led out from the water cooling facility by the time required for the steel sheet to pass through the water cooling facility.

Test pieces were taken from the obtained hot rolled steel sheets and examined for microstructure (scan type electron microscope and EBSD) and subjected to tensile tests, hole expansion tests, and fatigue tests by the complete reversed plane bending test method. The microstructures were observed using an apparatus comprised of a thermal field emission scan electron microscope (JSM-7001F made by JEOL) and an EBSD detector (HIKARI detector made by TSL) at an analysis speed of 200 to 300 points/sec. The average orientation difference in the same grain was found using software attached to the EBSD analysis apparatus (OIM Analysis™). Further, the hole expansion test was performed by punching a 10 mmφ hole in a test piece (initial hole: hole diameter d0=10 mm), turning the burr side up, using a conical punch with a top angle of 60 degrees to push against the initial hole until a crack passing through the sheet thickness occurred, measuring the hole diameter d1 mm when the crack occurred, and finding the hole expansion rate λ (%) by the following formula. The results of these are shown in Table 3.

$$\lambda=100\times(d1-d0)/d0$$

TABLE 1

| Steel | Chemical composition (mass %) | | | | | | | | | | | | Ae3 | A | |
|---|---|---|---|---|---|---|---|---|---|---|---|---|---|---|---|
| type | C | Si | Mn | P | S | Al | N | Ti | Nb | Mo | Cu | Ni | ° C. | ° C. | Remarks |
| A | 0.08 | 0.8 | 2.0 | 0.004 | 0.002 | 0.06 | 0.004 | | | | | | 872 | 725 | Newly developed steel |
| B | 0.05 | 0.02 | 2.1 | 0.003 | 0.002 | 0.01 | 0.004 | 0.10 | | | | | 848 | 727 | Newly developed steel |
| C | 0.10 | 0.05 | 1.5 | 0.003 | 0.003 | 0.02 | 0.003 | | 0.04 | | | | 852 | 759 | Newly developed steel |
| D | 0.08 | 0.6 | 2.1 | 0.002 | 0.001 | 0.08 | 0.004 | 0.14 | 0.02 | | | | 862 | 717 | Newly developed steel |
| E | 0.10 | 0.2 | 2.8 | 0.010 | 0.003 | 0.07 | 0.004 | 0.10 | | 0.03 | | | 822 | 653 | Newly developed steel |
| F | 0.15 | 0.7 | 1.4 | 0.022 | 0.004 | 0.06 | 0.003 | | | | 0.2 | 0.4 | 856 | 726 | Newly developed steel |
| G | 0.11 | 0.03 | 1.6 | 0.007 | 0.003 | 0.09 | 0.003 | | | 0.2 | | 0.02 | 848 | 731 | Newly developed steel |
| H | **0.25** | 0.2 | 1.5 | 0.004 | 0.003 | 0.05 | 0.004 | 0.04 | 0.03 | | | | 818 | 713 | Comp. steel |
| I | 0.10 | 0.4 | **3.7** | 0.010 | 0.003 | 0.04 | 0.004 | | | | | | 804 | 583 | Comp. steel |

Bold underlines show outside scope of present invention.

Empty fields show corresponding elements not proactively included.

[Table 4]

TABLE 3

| | | Microstructure | | | | | | | | | | | |
|---|---|---|---|---|---|---|---|---|---|---|---|---|---|
| | | α1 phases | | M-phases | | | Balance microstructure | | | Stretch | | | |
| No. | Steel type | Vol. rate % | Average grain size μm | Vol. rate % | Average grain size μm | α1 + M Vol. rate % | Vol. rate % | Average grain size μm | Tensile strength MPa | flangeability λ % | Fatigue strength MPa | Fatigue limit ratio — | Remarks |
| 1 | A | 65 | 0.7 | 33 | 4.3 | 98 | 2 | 1.4 | 834 | 114 | 525 | 0.63 | Ex. 1 |
| 2 | A | 65 | 1.9 | 32 | 7.7 | 97 | 3 | 7.1 | 824 | 120 | 461 | 0.56 | Ex. 2 |
| 3 | A | 69 | 3.1 | 30 | 6.9 | 99 | 1 | 9.4 | 812 | 134 | 430 | 0.53 | Ex. 3 |
| 4 | A | 0 | — | 99 | 5.2 | 99 | 1 | 1.1 | 908 | **86** | 427 | **0.47** | Comp. Ex. 4 |
| 5 | A | **23** | 3 | 64 | 7.4 | **87** | **13** | 10 | 591 | **49** | 364 | 0.55 | Comp. Ex. 5 |
| 6 | B | 69 | 2.5 | 27 | 1.6 | 96 | 4 | 2.2 | 827 | 134 | 455 | 0.55 | Ex. 6 |
| 7 | B | 41 | 3.4 | 55 | 4.3 | 96 | 4 | 5.4 | 799 | 117 | 407 | 0.51 | Ex. 7 |
| 8 | B | 63 | 2.9 | 37 | 2.8 | 100 | 0 | — | 746 | 103 | 380 | 0.51 | Ex. 8 |
| 9 | B | 70 | 3.4 | 28 | 6.2 | 98 | 2 | 2 | 712 | 105 | 392 | 0.55 | Ex. 9 |
| 10 | B | 47 | 1.3 | 29 | 7.9 | **76** | **24** | 7.2 | **570** | 90 | 251 | **0.44** | Comp. Ex. 10 |
| 11 | C | 68 | 4.3 | 29 | 4.2 | 97 | 3 | 6.3 | 707 | 102 | 361 | 0.51 | Ex. 11 |
| 12 | C | 66 | 4.1 | 34 | 9.2 | 100 | 0 | - | 659 | 135 | 369 | 0.56 | Ex. 12 |
| 13 | C | **27** | 4.4 | 53 | 5.8 | **80** | **20** | **11.2** | **564** | **60** | 392 | 0.56 | Comp. Ex. 13 |
| 14 | C | 49 | 2.7 | 46 | 5.7 | 95 | 5 | 9.7 | 774 | 98 | 503 | 0.65 | Ex. 14 |
| 15 | C | 69 | 2.1 | 30 | 2.9 | 99 | 1 | 8 | 750 | 105 | 465 | 0.62 | Ex. 15 |
| 16 | D | **87** | **14.5** | 12 | 9.2 | 99 | 1 | 3.6 | 599 | 94 | 227 | **0.41** | Comp. Ex. 16 |
| 17 | D | 61 | 2.3 | 36 | 2.6 | 97 | 3 | 1.8 | 697 | 90 | 425 | 0.61 | Ex. 17 |
| 18 | D | 45 | 4.2 | 55 | 5.6 | 100 | 0 | 8 | 754 | 111 | 385 | 0.51 | Ex. 18 |
| 19 | E | 59 | 4.5 | 38 | 6 | 97 | 3 | 2.5 | 818 | 137 | 458 | 0.56 | Ex. 19 |
| 20 | E | 58 | 2.2 | 38 | 7.7 | 96 | 4 | 9.7 | 864 | 112 | 484 | 0.56 | Ex. 20 |
| 21 | E | 56 | 3.7 | 43 | 7.8 | 99 | 1 | 5.2 | 699 | 100 | 398 | 0.57 | Ex. 21 |
| 22 | F | 56 | 3.1 | 42 | 6.2 | 98 | 2 | 5 | 776 | 92 | 404 | 0.52 | Ex. 22 |
| 23 | F | 56 | 3.4 | 42 | 7.7 | 98 | 2 | 2.3 | 832 | 91 | 483 | 0.58 | Ex. 23 |
| 24 | F | 47 | 2.7 | 48 | 5.4 | 95 | 5 | 5.6 | 854 | 124 | 529 | 0.62 | Ex. 24 |
| 25 | G | 67 | 2.1 | 31 | 9.2 | 98 | 2 | 1.8 | 647 | 138 | 375 | 0.58 | Ex. 25 |
| 26 | G | 47 | 4 | 52 | 5.1 | 99 | 1 | 1.1 | 873 | 107 | 463 | 0.53 | Ex. 26 |
| 27 | G | 50 | 2.1 | 49 | 3.6 | 99 | 1 | 4.8 | 842 | 110 | 480 | 0.57 | Ex. 27 |
| 28 | G | **11** | 0.8 | 85 | **13.4** | 96 | 4 | 8.8 | 884 | 111 | 398 | **0.40** | Comp. Ex. 28 |
| 29 | H | 57 | 1.4 | 39 | 6.1 | 96 | 4 | 2.9 | 783 | **62** | 462 | 0.59 | Comp. Ex. 29 |
| 30 | I | 50 | 4.3 | 45 | 5.1 | 95 | 5 | 9.7 | 724 | **47** | 405 | 0.56 | Comp. Ex. 30 |

Bold underlines show outside scope of present invention.

In Table 3, the "α1 phases" indicate ferrite with an average orientation difference in the same grain of 0.5° or more and 5.0° or less, while the "M phases" indicate martensite. Further, the "balance microstructure" included bainite and in addition included ferrite with an average orientation difference in the same grain of less than 0.5° and/or residual austenite. From Table 3, it is learned that the hot rolled steel sheets of the examples all have a tensile strength of 590 MPa or more and are excellent in stretch flangeability and fatigue characteristics. Note that "excellent in stretch flangeability" referred to here means a λ of 90% or more while "excellent in fatigue characteristics" means a fatigue limit ratio (fatigue strength/tensile strength) of 0.50 or more.

On the other hand, the hot rolled steel sheets of the comparative examples outside the scope of the present invention are inferior in stretch flangeability and/or fatigue characteristics. In Comparative Example 4, the rolling temperature of the final pass of the finishing rolling etc. is the $Ae_3$ point or more, so no ferrite transformation occurred during the rolling. As a result, fine structures of ferrite (ferrite with an average orientation difference in the same grain of 0.5° or more and 5.0° or less: 30 vol % or more and 70 vol % or less and average grain size of ferrite: 0.5 or more and 5.0 μm or less) cannot be obtained, so the stretch flangeability and also the fatigue characteristics deteriorate. In Comparative Example 5, the cooling rate is slower than 20° C./sec, recovery occurs in the ferrite with an average orientation difference in the same grain of 0.5° or more and 5.0° or less, the fraction of the balance microstructure increases, and as a result the difference in hardness from martensite increases and the stretch flangeability deteriorates. In Comparative Example 10, the coiling temperature (cooling stop temperature) is 300° C. or more, so the bainite fraction in the balance microstructure increases, that is, the balance microstructure increases to more than 10 vol %, and as a result the tensile strength and fatigue characteristics deteriorate. In Comparative Example 13, more than 10 seconds elapse from after the hot rolling (end of finishing rolling) to the start of cooling, recovery occurs in the ferrite with an average orientation difference in the same grain of 0.5° or more and 5.0° or less, the fraction of the balance microstructure increases, the tensile strength falls, the difference in hardness from martensite increases, and the stretch flangeability deteriorates.

In Comparative Example 16, during the finishing rolling, the rolling temperature becomes less than the A point. Ferrite is formed accompanying the drop in temperature during rolling, so the grain size of the ferrite with an average orientation difference in the same grain of 0.5° or more and 5.0° or less becomes larger to more than 5.0 μm and the fatigue characteristics fall. In Comparative Example 28, the total strain amount is less than 1.4, the volume rate of ferrite with an average orientation difference in the same grain of 0.5° or more and 5.0° or less decreases to less than 30 vol %, and the fraction of the fine grained structures becomes smaller. Further, the grain size of the martensite also becomes coarser, so the fatigue characteristics deteriorate. Comparative Example 29 satisfies the conditions of hot rolling, cooling, and coiling, but the amount of C is large, so the amount of cementite in the microstructure becomes greater, the hole expandability falls, and the stretch flangeability deteriorates. Similarly, Comparative Examples 30 satisfies the various conditions of hot rolling, cooling, and coiling, but the amount of Mn is large, so band structures are formed in the microstructure, the hole expandability falls, and the stretch flangeability deteriorates.

The invention claimed is:

1. A hot rolled steel sheet comprising a composition comprising, by mass %,

C: 0.01% or more and 0.20% or less,

Si: 1.0% or less,

Mn: 3.0% or less,

P: 0.040% or less,

S: 0.004% or less,

Al: 0.10% or less,

N: 0.004% or less, and a balance of Fe and impurities, wherein:

the hot rolled steel sheet comprises 30 vol % or more and 70 vol % or less of ferrite, with an average orientation difference in each grain of 0.5° or more and 5.0° or less, a total of ferrite and martensite is 90 vol % or more, and a balance microstructure is 10 vol % or less, and wherein an average grain size of the ferrite is 0.5 μm or more and 5.0 μm or less, an average grain size of the martensite is 1.0 μm or more and 10 μm or less, and, when there is the balance microstructure, an average grain size of the balance microstructure is 1.0 μm or more and 10 μm or less.

2. The hot rolled steel sheet according to claim 1, further comprising, by mass %, one or more of:

Nb: 0.01% or more and 0.20% or less,

Ti: 0.01% or more and 0.15% or less,

Mo: 0.01% or more and 1.0% or less,

Cu: 0.01% or more and 0.5% or less, and

Ni: 0.01% or more and 0.5% or less.

3. A method for producing the hot rolled steel sheet according to claim 1, comprising:

(a) hot rolling a cast steel stock comprising the composition according to claim 1 without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less to obtain a finishing rolled steel sheet, (b) cooling the finishing rolled steel sheet by a 20° C./sec or more average cooling rate, wherein the cooling is started within 10 seconds after the hot rolling to obtain a steel sheet, and (c) coiling the steel sheet at room temperature or more and less than 300° C. in temperature range, where, the A point is a temperature found by the following (formula 1) and the $Ae_3$ point is a temperature found by the following (formula 2):

$$A(°\ C.)=910-310C-80Mn-20Cu-55Ni-80Mo \quad \text{(formula 1)}$$

$$Ae_3(°\ C.)=919-266C+38Si-28Mn-27Ni+12Mo \quad \text{(formula 2)}$$

where, C, Si, Mn, Cu, Ni, and Mo are contents, in mass %, of each element.

4. A method for producing the hot rolled steel sheet according to claim 2, comprising:

(a) hot rolling a cast steel stock comprising the composition according to claim 2 without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less to obtain a finishing rolled steel sheet, (b) cooling the finishing rolled steel sheet by a 20° C./sec or more average cooling rate, wherein the cooling is started within 10 seconds after the hot rolling to obtain a steel sheet, and (c) coiling the steel sheet at room temperature or more and less than 300° C. in temperature range, where, the A point is a temperature found by the following (formula 1) and the $Ae_3$ point is a temperature found by the following (formula 2):

$$A(°\ C.)=910-310C-80Mn-20Cu-55Ni-80Mo \quad \text{(formula 1)}$$

$$Ae_3(°\ C.)=919-266C+38Si-28Mn-27Ni+12Mo \quad \text{(formula 2)}$$

where, C, Si, Mn, Cu, Ni, and Mo are contents, in mass %, of each element.

* * * * *